United States Patent [19]

Boes et al.

[11] Patent Number: 4,769,163

[45] Date of Patent: Sep. 6, 1988

[54] PHTHALOCYANINE COMPLEX-FILLED GREASES

[75] Inventors: David J. Boes, Monroeville; George R. Kelecava, Youngwood; Mary A. Alvin, Pittsburgh, all of Pa.

[73] Assignee: Westinghouse Electric Corp., Pittsburgh, Pa.

[21] Appl. No.: 43,574

[22] Filed: Apr. 27, 1987

[51] Int. Cl.[4] ..... C10M 119/30

[52] U.S. Cl. ..... 252/46.4; 252/49.7; 252/52 R; 252/54; 252/56 R

[58] Field of Search ..... 252/49.7, 46.4, 46.3

[56] References Cited

U.S. PATENT DOCUMENTS

| | | | |
|---|---|---|---|
| 2,597,018 | 5/1952 | Merker et al. | 252/42.7 |
| 2,836,563 | 5/1958 | Dilworth et al. | 252/49.7 |
| 2,929,779 | 3/1960 | Sullivan et al. | 252/49.7 |
| 3,051,721 | 8/1962 | Pfeiffer | 252/49.7 |
| 3,432,432 | 3/1969 | Dreker | 252/25 |

*Primary Examiner*—William R. Dixon, Jr.

*Attorney, Agent, or Firm*—J. L. Morrison

[57] ABSTRACT

Disclosed is a lubricating grease composition of about 90 to about 99% by weight of a lubricant and about 1 to about 5% by weight of polymeric organometallic phthalocyanine complex, including nitrogen-substituted analogues thereof, where the complexed metal ion is a Group IVA metal. The lubricating composition is used in ball and roller bearings, especially at high speeds and high temperatures.

13 Claims, No Drawings

PHTHALOCYANINE COMPLEX-FILLED GREASES

BACKGROUND OF THE INVENTION

In order to increase the life of grease lubricated bearings that are operated at high temperatures, high speeds, or both, various additives and thickeners are added to the bearing lubricants. It has been found, for example, that some compounds that have a lattice structure are good additives for lubricants. These include the selenides and sulfides of tungsten, molybdenum, tantalum, and niobium However, it has also been found that compounds that are chemically similar and that also have a lattice structure have a very poor lubricating ability. For example, tellurium is chemically very similar to selenium, but the tellurides of tungsten, molybdeneum, tantalum, and niobium are very poor lubricants. Other compounds that have a lattice structure, such as calcium fluoride, are also poor lubricants, and titanium sulfide, which also has a lattice structure, is actually abrasive. Thus, it is difficult to predict from the chemical structure alone whether or not a compound that has a lattice structure will actually perform well as a lubricant.

SUMMARY OF THE INVENTION

We have discovered that a polymer of an organometallic phthalocyanine complex can be used as a grease additive, and that the resulting grease greatly extends the life of bearings, especially if they are run at high temperatures, high speeds, or both. While the complexes used in this invention have a lattice structure, it is surprising that they function so well in greases because some of the complexes have silicon-oxygen bonds which might be expected to form highly abrasive quartz ($SiO_2$) at high temperatures. Nevertheless, we have found that synthetic greases incorporating the additives of this invention can increase the life of bearings over ten times, compared to the same grease with no additive being present.

DESCRIPTION OF THE INVENTION

The additives of this invention are useful with any type of grease, including natural, petroleum-based greases as well as synthetic lubricants. Synthetic lubricants are preferred as they can withstand higher temperatures than can petroleum-based greases, and the benefits of this invention are greatest at higher temperatures. Examples of synthetic lubricants that can be used include perfluoroethers, diesters, silicones, polyphenylethers, and mixtures thereof.

The organometallic phthalocyanine complexes of this invention include nitrogen-substituted anologues of such complexes. These complexes are polymers having the following repeating unit, (including substitutions thereof):

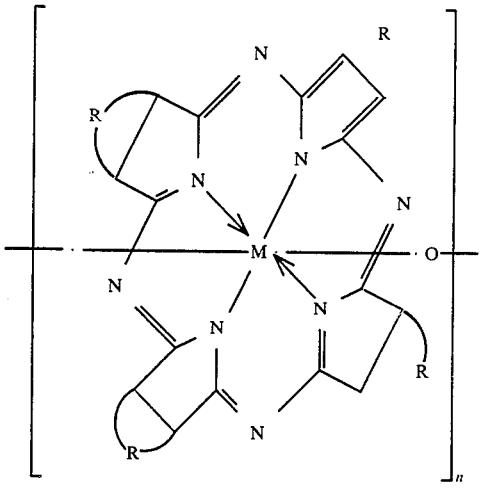

In the above general formula, the polymer chain is perpendicular to the plane of the atoms that form each repeating unit.

Each R group in the formula is a divalent organic group preferably independently selected from

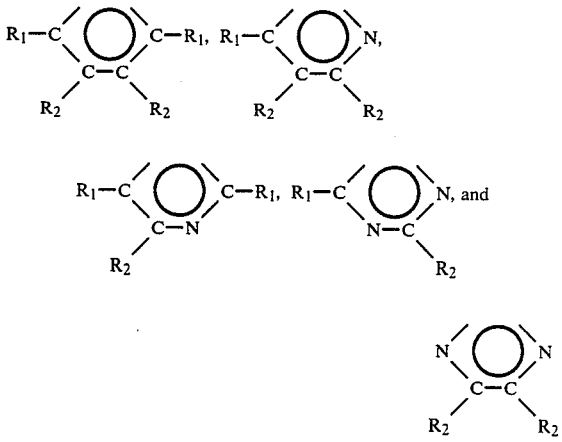

All the R groups form conjugated rings. The R group that contains only carbon atoms in the ring forms a phthalocyanine complex and provides maximum resonance stability to the polymeric complex. The R groups that contain one or two nitrogen atoms in the ring form the nitrogen-substituted analogues. In the R groups, each $R_1$ is independently selected from hydrogen, $-SO_3H$, $-SO_2NHR_3$, $-NO_2$, alkyl to $C_4$, and alkylene to $C_4$, each $R_2$ is independently selected from $R_1$, phenyl, substituted phenyl, and a divalent 4-membered conjugated hydrocarbon chain, and each $R_3$ is independently selected from hydrogen, $C_6H_4SO_3H$, and 2-hydroxy-6-sulfo-1-naphthyl. In the general formula, the M atom is a group IVA metal, and preferably each M is independently selected from silicon, germanium, and tin. The number of repeating units is represented by "n" in the formula; "n" is preferably about 10 to about 200. Preferably, each $R_1$ group, each $R_2$ group, each $R_3$ group, and the metal M in each repeating unit are identical as that simplifies synthesis.

The M group in the formula is most preferably silicon as that compound seems to work well, and $R_1$ and $R_2$ are preferably hydrogen as that compound is easier to make. The preparation of these polymers has been described in the literature. See, for example, Ph.D. thesis by Karl Frederick Schock, Jr., titled, "Electrically-Conductive Group IV A Phthalocyanine Polymers," Northwestern University, June, 1982, herein incorporated for reference. The polymers as prepared are finely powdered solids.

A lubricating composition is prepared by simply mixing the lubricating grease with the additive. A suitable proportion is about 90 to about 99% (all percentages herein are by weight based as total composition weight) of the lubricant and about 1 to about 10% of the additive, and a preferred composition is about 95 to about 97% of the lubricant and about 3 to about 5% of the additive. If too much additive is used, the lubricating composition may bind, and there is no additional benefit to the use of excess additive. On the other hand, if too little additive is used, the life of the bearing will not be extended as much.

The lubricating composition of this invention can be used with any type of rolling bearing, including ball bearings, roller bearings, and other types of bearings such as linear bearings. It is particularly useful with steel bearings, such as 52100 steel bearings, and is preferably used with stainless steel bearings as they are corrosion resistant and are more likely to be used in high-temperature, high-speed applications. However, the composition can also be used with plastic bearings and ceramic bearings, as well as with other types of bearings. The lubricating composition is particularly useful with bearings operating at temperatures between 160° F. and 500° F. in oxidizing atmospheres or in excess of 500° F. in a vacuum, as it is under those conditions that the advantages of this invention in extending the life of ball or roller bearings are most obvious. For the same reason, bearings that are operated at a DN (diameter in millimeters times speed in rpm) greater than 300,000 will also benefit from the use of the lubricating compositions of this invention.

The following examples further illustrate this invention.

EXAMPLE 1

In these examples a synthetic grease sold by DuPont Corporation under the trade designation "KRYTOX 283," believed to be a polymer of a perfluoroalkylether, was used. Lubricating compositions were made up by mixing the "Krytox" grease with 5% nickel phthalocyanine or a 5% silicon phthalocyanine polymer. Spindle bearings having a shaft diameter of 0.984 inch using 205FFT5 ball bearings having an outside diameter of 2.047 inch were packed with the greases and were operated at 21000 rpm at a thrust load of 30 lbs. and a radial load of 1½ lbs. The following table gives the test conditions and the time until the bearing failed.

| Additive | Grease Charge (gms) | Test Temp (°F.) | Average Running Temp (°F.) | Time to Failure (hrs) |
|---|---|---|---|---|
| None | 0.60 | 70 | 125 | 495 |
| None | 0.60 | 70 | 110 | 685 |
| 5% NiPc* | 0.70 | 70 | 100 | 950 |
| 5% NiPlc* | 1.4 | 160 | 200 | 3000 |
| 5% $[SiPcO]_n$** | 1.4 | 160 | 185 | >7000 |

*NiPc = Nickel phthalocyanine
**$[SiPcO]_n$ = Silicon phthalocyanine polymer

The above table shows that while the nickel phthalocyanine additive substantially increased the life of the bearing, the silicon phthalocyanine polymer additive of this invention increased the life of the bearing more than twice as much, and more than ten times as much as no additive at all.

What is claimed is:

1. A lubricating grease composition comprising
(a) about 90 to about 99 weight percent of a lubricant; and
(b) about 1 to about 10 weight percent of a polymeric organometallic phthalocyanine complex, including nitrogen-substituted analogues thereof, where the complexed metal ion is a Group IVA metal.

2. A composition according to claim 1 wherein said lubricant is a synthetic lubricant.

3. A composition according to claim 1 wherein said lubricant is selected from the group consisting of perfluorethers, diesters, silicones, polyphenylethers, and mixtures thereof.

4. A composition according to claim 1 wherein said lubricant is a polymer of perfluoroalkylether.

5. A composition according to claim 1 wherein said lubricant is a petroleum-based lubricant.

6. A composition according to claim 1 wherein said Group IV A metal is selected from the group consisting of silicon, germanium, tin, and mixtures thereof.

7. A composition according to claim 1 wherein said complex has the general formula

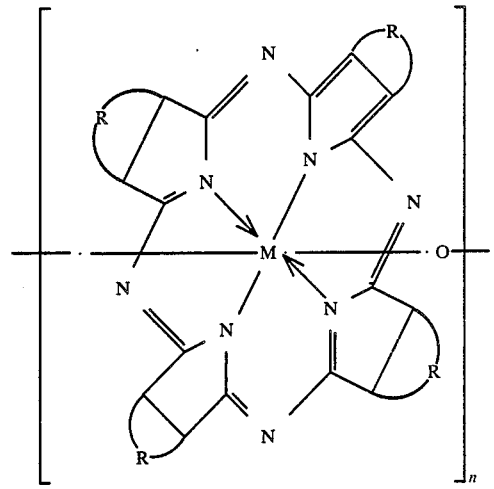

where each M is independently selected from silicon, germanium, and tin, R is a a divalent organic group, and n is about 10 to about 200.

8. A composition according to claim 7 wherein each R group is independently selected from

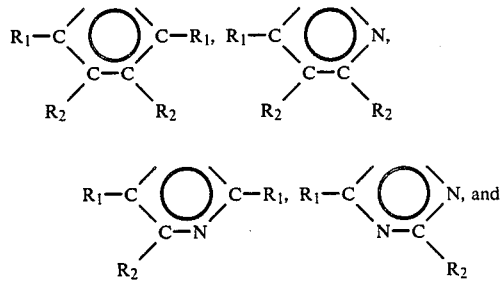

-continued

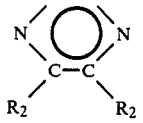

where each $R_1$ is independently selected from —H, —$SO_3H$, —$SO_2NHR_3$, —$NO_2$, alkyl to $C_4$, and alkylene to $C_4$, each $R_2$ is independently selected from $R_1$, phenyl, substituted phenyl, and a divalent 4-membered conjugated hydrocarbon chain, and each $R_3$ is independently selected from —H, —$C_6H_4SO_3H$, and 2-hydroxy-6-sulfo-1-naphthyl.

9. A composition according to claim 7 wherein each M is silicon.

10. A composition according to claim 8 wherein each $R_1$ and each $R_2$ is hydrogen.

11. A composition according to claim 8 wherein each M is silicon.

12. A method of increasing the life of a bearing comprising packing said bearing with a lubricating composition according to claim 1.

13. A lubrication composition comprising (a) about 95 to about 97% of a synthetic lubricant selected from the group consisting of perfluoroethers, diesters, silicones, polyphenylethers, and mixtures thereof; and (b) about 3 to about 5 weight percent of a polymeric organometallic phthalocyanine complex having the general formula

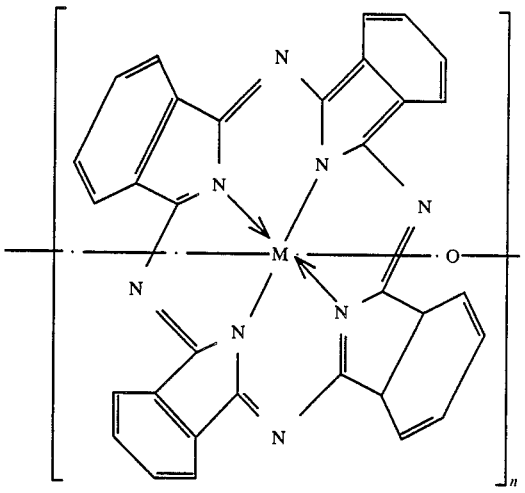

where each M is independently selected from silicon, germanium, and tin.

* * * * *